US005848551A

United States Patent [19]

Ohmi et al.

[11] Patent Number: 5,848,551

[45] Date of Patent: Dec. 15, 1998

[54] STARTER HAVING IMPROVED PINION DRIVING MECHANISM

[75] Inventors: Masanori Ohmi, Anjo; Takeshi Araki, Nishikasugai-gun; Nobuyuki Hayashi, Nagoya, all of Japan

[73] Assignee: Denso Corporation, Kariya, Japan

[21] Appl. No.: 799,388

[22] Filed: Feb. 11, 1997

[30] Foreign Application Priority Data

Feb. 29, 1996 [JP] Japan ..... 8-043100

[51] Int. Cl.[6] ..... F02N 11/00

[52] U.S. Cl. ..... 74/7 C; 74/7 A; 74/7 E; 290/38 R

[58] Field of Search ..... 74/7 C, 7 E, 7 A; 290/38 R, 38 C, 48

[56] References Cited

U.S. PATENT DOCUMENTS 4,590,811 5/1986 Kasubuchi ..... 74/7 E 4,974,463 12/1990 Luiki ..... 74/7 A 5,370,009 12/1994 Isozumi ..... 74/7 C

FOREIGN PATENT DOCUMENTS 2 041 452 9/1980 United Kingdom .

*Primary Examiner*—Charles A. Marmor

*Assistant Examiner*—Troy Grabow

*Attorney, Agent, or Firm*—Pillsbury Madison & Sutro LLP

[57] ABSTRACT

In a starter having a pinion gear on an output shaft driven by a starter motor, a magnet switch, and a shift lever pivotally connecting the pinion and the magnet switch, the shift lever is formed at one end thereof with an annular arm body for engagement with the pinion gear. The annular arm body is engaged with the pinion gear to receive the pinion returning force evenly thereby to prevent damage on the shift lever. Preferably the annular arm body is engaged with the pinion gear through a plate and a bearing.

5 Claims, 4 Drawing Sheets

STARTER HAVING IMPROVED PINION DRIVING MECHANISM

CROSS REFERENCE TO RELATED APPLICATION

This application is based on and claims a priority of Japanese Patent Application No. 8-43100 filed on Feb. 29, 1996, the contents of which are incorporated herein by reference.

BACKGROUND OF THE INVENTION

1. Field of the Invention:

The present invention relates to a starter for starting an internal combustion engine and, more particularly, to a starter having an improved mechanism for moving a pinion for engagement with an engine ring gear.

2. Description of Related Art:

In one type of starters, a sleeve which is helical spline-fitted on a starter output shaft is driven by a magnet switch through a shift lever thereby to move a pinion transmittal member having a pinion gear to the engine ring gear side. JP-A 55-107067 and its family member GB 2041452A teach such a starter in which the shift lever is made of resin to increase resistivity to vibrations and to reduce operation noise.

In starters, a large returning force exerts on the pinion transmittal member through the helical spline during combustion strokes of the engine. The shift lever receives the returning force at its pair of forks and therefore the forks must have a sufficient mechanical strength. Further the forks sometimes have to receive the returning force unevenly, because of inclinations of the pinion transmittal member against the output shaft and of the shift lever against the pinion transmittal member. Thus, the forks must have the higher strength. The resin-made shift lever must be thickened enough to withstand the large and uneven returning force and becomes resultantly large-sized.

In another type of starters, e.g., a reduction-type starter in which support pins for supporting planetary gears of a planetary gear speed reduction mechanism are fixed to an outer member of a one-way clutch, the one-way clutch is disposed immovably against a starter output shaft and a pinion gear is mounted on the output shaft to be moved by a shift lever. The shift lever directly receives the high speed rotation of the pinion gear at the time of overrunning. As a result, vibrations exerting axially on the shift lever become large. Thus, the shift lever must be sufficiently resistive to vibrations and high speed rotations, resulting in the large-sized design.

SUMMARY OF THE INVENTION

It is therefore an object of the present invention to provide a starter having a shift lever of sufficient mechanical strength without requiring a large-sized design.

According to the present invention, a shift lever driven by a magnet switch to drive a pinion transmittal member is constructed in the form of an annular body by connecting a pair of arms at a bottom end. The shift lever has a sufficient mechanical strength to withstand the returning force applied from the engine side to a pinion transmittal member and need not be thickened. The ring body receives and withstands the returning force and therefore has a higher rigidity than in the case of separating a pair of annular arms. Thus, the shift lever can be made light-weight.

Preferably, the pinion transmittal member has a holding portion provided rotatably against a pinion gear. The rotation of pinion gear is not transmitted directly to the annular arms even during the rotation of pinion gear in engagement with an engine ring gear. The relative rotation between the pinion gear and the holding portion reduces the rotating force transmitted to the annular arms. Thus, frictional heat generated and vibrations caused by the relative rotation between the holding portion and the annular arms can be reduced remarkably.

More preferably, the holding portion has an engagement portion which is rotatable together with the holding portion against the pinion gear. The shift lever restricts the rotation of engagement portion thereby to increase resistivity to vibrations and high speed rotations.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PRESENTLY PREFERRED EMBODIMENTS

Figure 1:
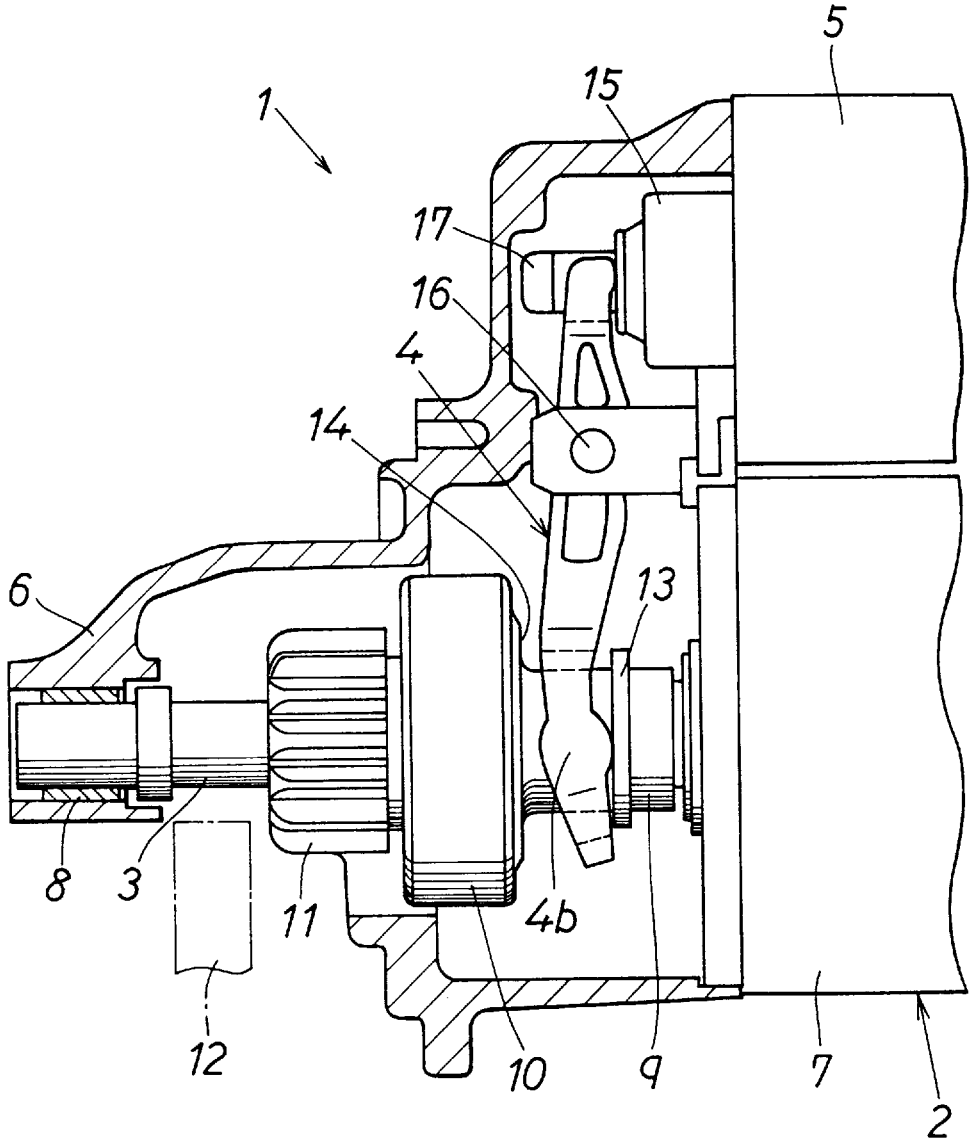
FIG. 1 is a sectional view showing schematically a starter with a shift lever in a normal stationary position according to the first embodiment of the present invention.

The present invention will be described below with reference to various embodiments in which same reference numerals denote the same or similar component parts.

(First Embodiment)

Figure 2:
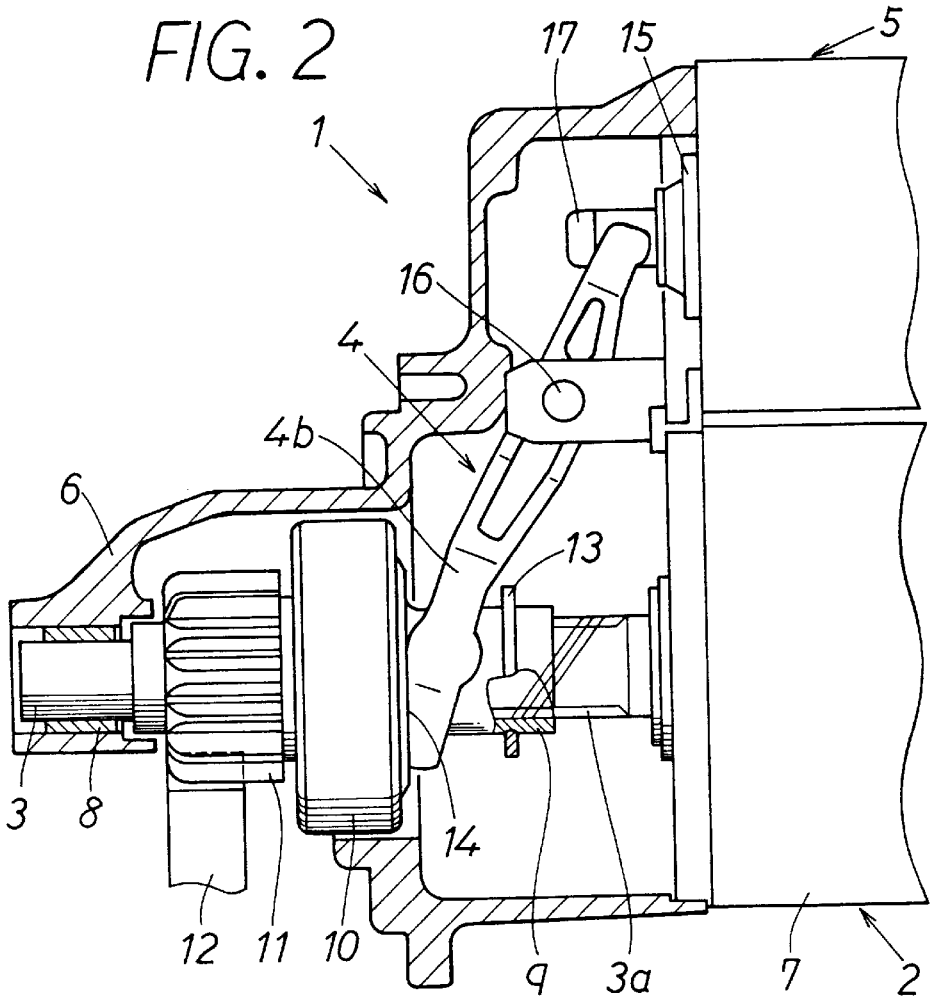
FIG. 2 is a sectional view showing schematically the starter with the shift lever in an engagement position according to the first embodiment.
Figure 3:
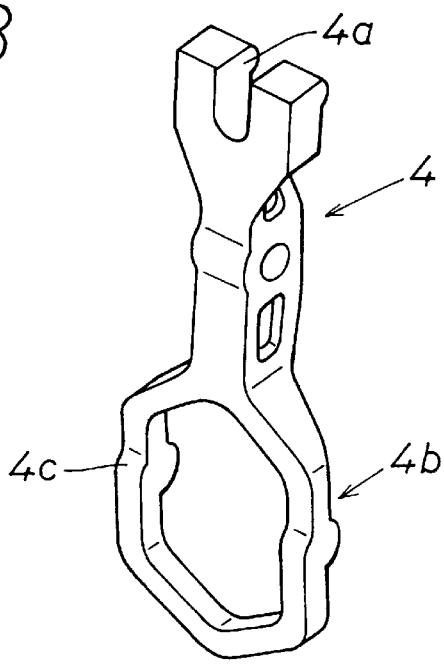
FIG. 3 is a schematic view showing the shift lever used in the first embodiment.

As shown in FIGS. 1 through 3, a starter 1 includes a starter motor 2 for generating a rotational force when energized, a speed reduction mechanism (not shown) for transmitting the rotation of starter motor 1 to an output shaft 3 in a reduced speed, a pinion transmittal member disposed axially movably on the output shaft 3, a magnet switch 5 for driving the pinion transmittal member through a shift lever 4 and controlling energization of the starter motor 2, and the like.

The starter motor 2 comprises a d.c. motor having an armature (not shown) which is energized to rotate when a starter switch (not shown) is turned on and a motor switch within the magnet switch 5 is closed.

The output shaft 3 is disposed at the front side of the starter motor 2 coaxially with the armature shaft (not shown)

of the starter motor 2 and is supported rotatably by a housing 6 and a casing 7 through bearings 8 (bearing at the side of casing 7 is not shown).

The speed reduction mechanism comprises a planetary gear reduction mechanism which has a large reduction ratio and disposed coaxially at the front side of the starter motor 2.

The pinion transmittal member comprises a sleeve 9, a one-way clutch 10 and a pinion gear 11. The pinion transmittal member is mounted axially movably along the output shaft 3 between the normal stationary position (FIG. 1) and an engagement position (FIG. 2) for engagement with a ring gear 12 of an engine.

The sleeve 9 is fitted around the outer periphery of the output shaft 3 through a helical spline 3*a* (FIG. 2) to move axially along the helical spline 3*a*. An annular protrusion 13 is formed around the outer periphery of the rear side of the sleeve 9 to receive a pinion returning force of the magnet switch 5 through the shift lever 4 at the time the pinion transmittal member returns from the engagement position to the normal stationary position.

A holding portion 14 is formed at the front end side of the sleeve 9 to receive the pinion pushing force of the magnet switch 5 through the shift lever 4 at the time the pinion transmittal member moves from the stationary position to the engagement position. The holding portion 14 is formed by a side wall extending radially outwardly from the sleeve 9 toward an outer member (not shown) of the one-way clutch 10.

The one-way clutch 10 is disposed between the sleeve 9 and the pinion gear 11 to transmit the rotation of sleeve 9 to the pinion gear 11 and shuts off the transmission of rotation from the pinion gear 11 to the sleeve 9.

The pinion gear 11 advances together with the sleeve 9 and the one-way clutch 10 along the output shaft 3 and engages the ring gear 12 of the engine to transmit the rotation of starter motor 2 to the ring gear 12.

The magnet switch 5 has an exciting coil (not shown) which generates a magnetic force when energized to attract a plunger 15 disposed inside the coil for closing a motor contact and driving the shift lever 4 by the attraction force of plunger 15.

The shift lever 4 is provided to swivel or pivot around a support pin 16 fixed to the housing 6. As shown in FIG. 3, the shift lever 4 has at a top end thereof an engagement groove 4*a* which engages a joint 17 coupled with the plunger 15 and at a bottom end thereof an annular arm body 4*b* which is mounted on the outer periphery of the sleeve 9 between the protrusion 13 and the holding portion 14. The annular arm body 4*b* has a pair of branched forks or arms 4*c* coupled to each other at both ends thereof. The sleeve 9 is held rotatably and axially movably against the annular arm body 4*b*.

The starter according to the first embodiment operates as follows.

When the starter switch is turned on and the coil within the magnet switch 5 is energized to attract the plunger 15, one end of the shift lever 4 engaged with the joint 17 moves toward the magnet switch 5 and the annular arm body 4*b* mounted around the outer periphery of the sleeve moves forward toward the ring gear 12. At this time the annular arm body 4*b* of the shift lever 4 axially moves on the outer periphery of the sleeve 9 and the front side end (clutch side end) of the annular arm body 4*b* abuts the holding portion 14 to push out the pinion transmittal member toward the ring gear 12 (FIG. 2) so that the pinion gear engages the ring gear 12.

With the motor contact in the magnet switch being closed, an electric current flows from the battery to the starter motor 2 to rotate the armature. The rotation of the armature is reduced by the speed reduction mechanism and transmitted to the output shaft 3. The rotation of the output shaft 3 is transmitted from the sleeve 9 to the pinion gear 11 through the one-way clutch 10. The pinion gear 11 engaged with the ring gear 12 rotates the ring gear 12 thereby to start the engine.

When the starter switch is turned off and the plunger 15 of the magnet switch 5 returns to the initial position (FIG. 1) to open the motor contact, the starter motor 2 is deenergized and stops the armature rotation. The return of plunger 15 turns the shift lever 4 oppositely to the engine starting time. The annular arm body 4*b* moves along the outer periphery of the sleeve 9 axially oppositely to the engine starting time so that the rear side end of the annular arm body 4*b* abuts the annular protrusion 13 and pushes back the pinion transmittal member. At this time the pinion gear 11 disengages from the ring gear 12 and returns along the output shaft 3 axially to the initial position (FIG. 1).

The present embodiment has the following advantages.

During the engagement of the pinion gear 11 with the ring gear 12 for engine starting, the rotational force of the engine is transmitted from the ring gear 12 to the pinion gear 11 at every combustion stroke of the engine. This rotational force exerts as the pinion returning force on the pinion transmittal member through the helical spline 3*a*. The annular arm body 4*b* of the shift lever 4 abutting the holding portion 14 receives this pinion returning force. Because the annular arm body 4*b* is formed in the ring shape to have a high rigidity, the annular body 4*b* can withstand the large pinion returning force.

As opposed to the separated fork shape of the shift lever in which the forks are likely to receive the pinion returning force unevenly resulting in possibility of damaging the forks, the annular arm body 4*b* receives and withstands the pinion returning force. Therefore, the shift lever 4 is enabled to have a high enough rigidity to receive and withstand the pinion returning force without thickening the shift lever 4 for an increased rigidity.

(Second Embodiment)

Figure 4:
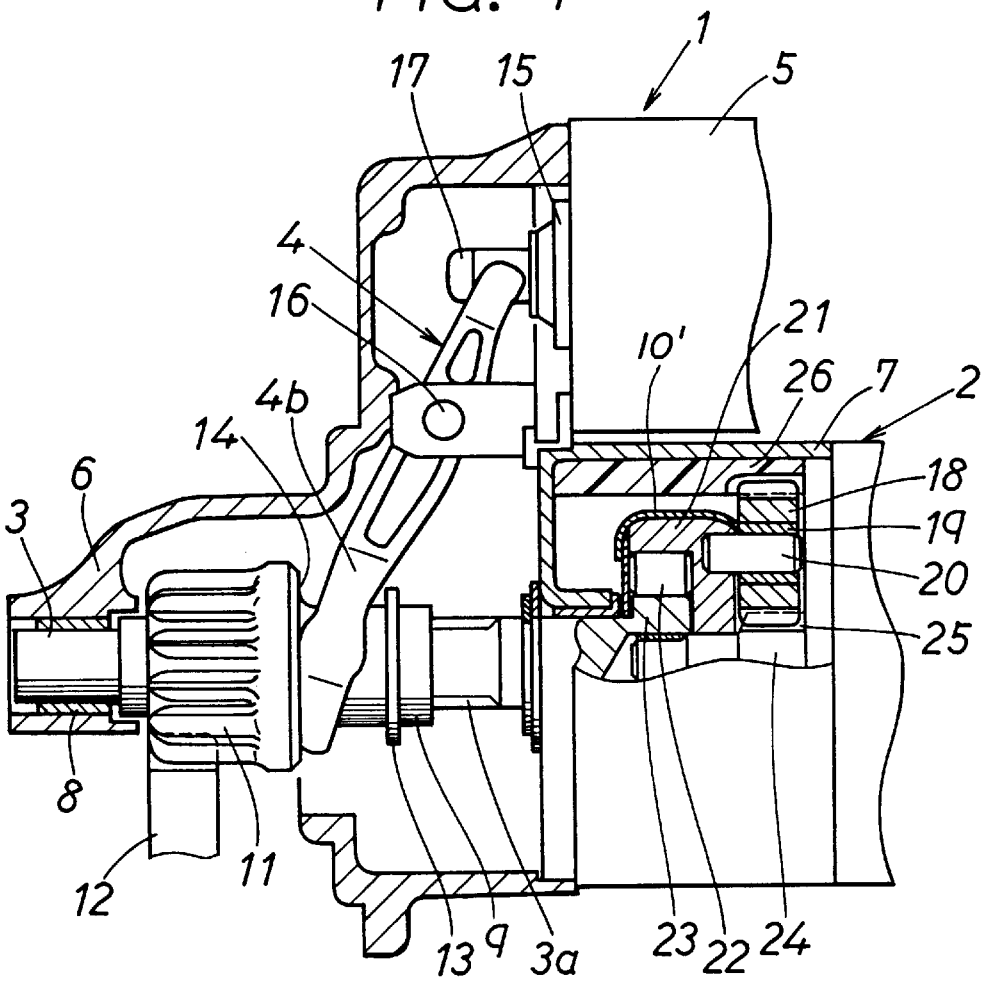
FIG. 4 is a sectional view showing schematically a starter according to the second embodiment of the present invention.

In the second embodiment shown in FIG. 4, the one-way clutch 10' is not integrated with the pinion transmittal member but mounted immovably relative to the output shaft 3. Pins 20 which support planetary gears 18 of the planetary gear speed reduction mechanism through bearings 19 are press-fitted directly into an outer member 21 of the one-way clutch 10' . An inner member 23 which radially faces the outer member 21 through rollers 22 is formed integrally with the output shaft 3.

The speed reduction mechanism comprises a sun gear 25 formed around a forward end of an armature shaft 24, a plurality of planetary gears 18 engaged with the sun gear 25, and an interval gear 26 engaged with the planetary gears 18 and fixed to a casing 7. The interval gear 26 may alternatively be held by the casing 7 through a shock absorbing device.

The pinion transmittal member comprises the sleeve 9 fitted on the output shaft 3 through the helical spline 3*a* and the pinion gear 11 provided movably on the output shaft 3 together with the sleeve 9. The pinion transmittal member has no one-way clutch thereon and hence its weight is reduced. Therefore the magnet switch 5 which generates the force to push out the pinion transmittal member can be designed compactly. The sleeve 9 has the annular protrusion 13 and the holding portion 14 between which the annular arm body 4*b* of the shift lever 4 is engaged.

In this starter 1 having no one-way clutch on the pinion transmittal member, when the engine starts to rotate and the pinion transmittal member overruns, rotational force of the engine is transmitted directly to the pinion transmittal member. As a result, the annular arm body 4*b* of the shift lever 4 receives from the holding portion 14 both the large pinion returning force produced by the helical spline 3*a* and the rotational force which corresponds to the product of the engine rotational speed and a gear teeth ratio between the ring gear 12 and the pinion gear 11. That is, the vibrations arising from the high relative rotation speed exert on the shift lever 4. The shift lever 4 can withstand such vibrations owing to the ring-shaped annular arm body 4*b* which has the high enough rigidity.

(Third Embodiment)

Figure 5:
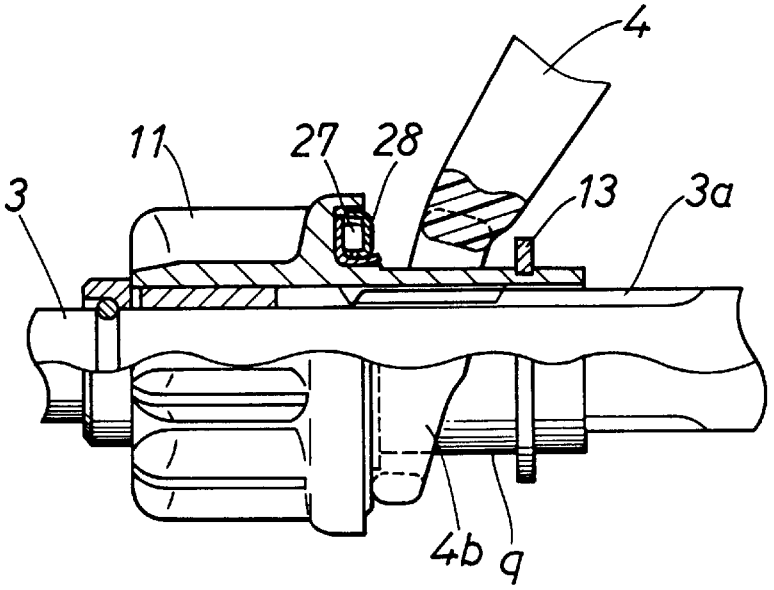
FIG. 5 is a partial sectional view showing a pinion transmittal member used in the third embodiment of the present invention.

In the third embodiment shown in FIG. 5, a plate 28 is fitted to a rear end of the pinion gear 11 rotatably relative to the pinion gear 11 through a thrust bearing 27. The plate 28 works as the holding portion which receives the pinion pushing-out force of the magnet switch 5 through the annular arm body 4*b*. This plate 28 restricts the direct transmission of rotation of the pinion gear 11 to the annular arm body 4*b* even during the rotation of the pinion gear 11 withstand the condition of the engagement with the ring gear 12, because the relative rotation between the pinion gear 11 and the plate 12 reduces the rotating force to be transmitted to the annular arm body 4*b*. As a result, frictional heat produced by the relative rotation between the plate 28 and the annular arm body 4*b* and the vibrations produced by the friction are both reduced remarkably, resulting in improved resistivity to vibrations and high speed rotation. Further, the shift lever 4 can be made of resin.

(Fourth Embodiment)

Figure 6A:
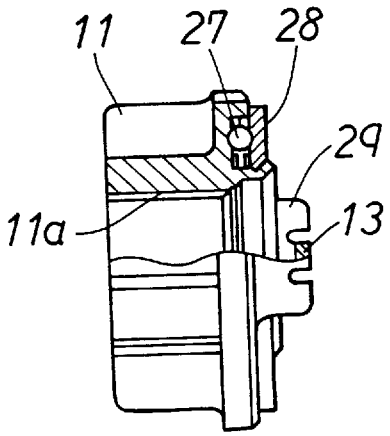
FIGS. 6A and 6B are a partial sectional view and a front view of a pinion transmittal member and a shift lever, respectively, according to the fourth embodiment of the present invention.
Figure 6B:
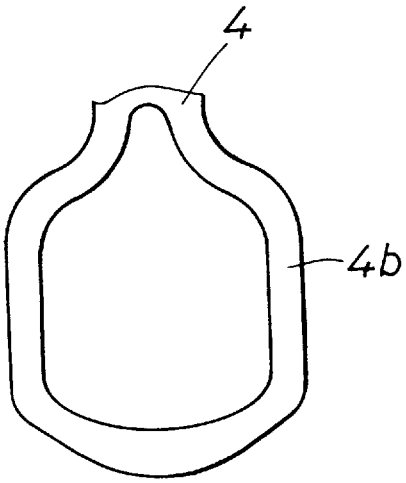

In the fourth embodiment shown in FIGS. 6A and 6B, the pinion gear 11 is formed on its inner periphery with a helical spline ll*a* which engages the helical spline 3*a* of the output shaft 3. Thus, the sleeve 9 used in the first through the third embodiments is eliminated. The plate 28 (holding portion) fitted rotatably relative to the pinion gear 11 through the thrust bearing 27 is formed with protrusions 13 integrally for engagement with the annular arm body 4*b* of the shift lever 4.

As shown in FIG. 6A, the plate 28 is formed with a pair of support walls 29 raised perpendicularly at both radial ends of the plate 28. Free ends of the raised support walls 29 are bent radially inwardly to provide the protrusions 13 in the hook shape. As shown in FIG. 6B, the annular arm body 4*b* of the shift lever 4 is made of a thin metal plate to be engaged between the plate 28 and the protrusion 13. The annular arm body 4*b* has a pair of straight arm portions, which engage the raised support walls 29 of the plate 28, respectively, to restrict rotations of the plate 28.

With no relative rotational movement between the shift lever 4 and the plate 28 the resistivity to vibrations and high speed rotations is improved. Further, owing to the integral formation of the protrusion 13 with the plate 28 and close enough positioning of those two, the axial length of the pinion transmittal member can be shortened and, in the end, the starter can be made in compact and light-weight design.

(Fifth Embodiment)

Figure 7A:
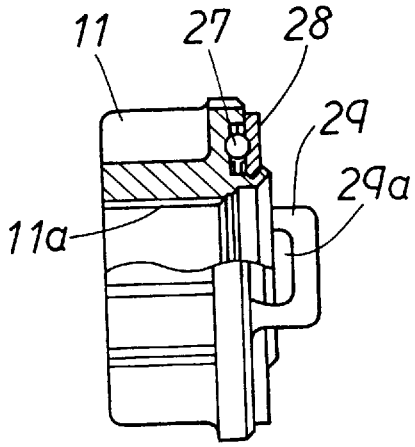
FIGS. 7A and 7B are a partial sectional view and a front view of a pinion transmittal member and a shift lever, respectively, according to the fifth embodiment of the present invention.
Figure 7B:
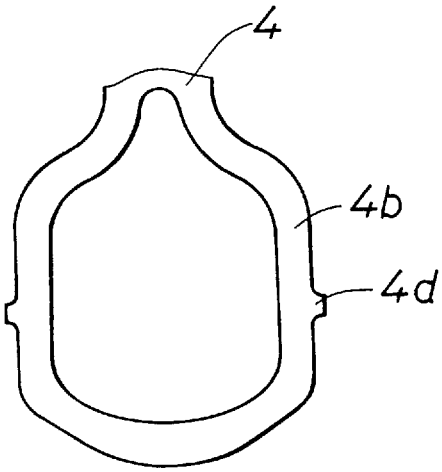

In the fifth embodiment shown in FIGS. 7A and 7B, as in the fourth embodiment, the pinion gear 11 has the helical spline ll*a* to eliminate the sleeve and the plate 28 has a pair of the raised support walls 29.

The support walls 29 have respective holes 29*a*. The shift lever 4 has projections 4*d* formed on the straight arm portions of the annular arm body 4*b* so that the annular arm body 4*b* is engaged with the plate 28 by inserting the projections 4*d* into the holes 29*a*. The pinion gear 11 is returned to its initial position after engine starting by the projections 4*d* abutting the rear wall of the hole 29*a*.

The relative rotation between the shift lever 4 and the plate 28 is restricted in the same manner as in the fourth embodiment, and the same advantage as in the fourth embodiment can be provided.

The present invention having been described should not be restricted to the disclosed embodiments but may be modified in various ways without departing from the scope and spirit of the invention.

What is claimed is:

1. A starter for starting an engine having a ring gear, comprising:

a starter motor;

an output shaft driven by the starter motor;

a pinion transmittal member having a spline portion fitted axially movably on the output shaft through a spline, and a pinion gear engageable with the ring gear; and a pinion driving means including a shift lever for moving the pinion transmittal member, the shift lever having a pair of arms engaged with the pinion transmittal member and coupled to each other at ends thereof to form an annular arm body.

2. The starter according to claim 1, wherein:

the pinion transmittal member has a holding portion which the annular arm body abuts to restrict return of the pinion transmittal member during engagement of the pinion transmittal member with the ring gear;

the holding portion is provided rotatably relative to the pinion gear.

3. The starter according to claim 2, wherein:

the holding portion has an engagement portion formed integrally therewith and engaged with the annular arm portion so that the holding portion is restricted from rotating by the shift lever through the annular arm body.

4. The starter according to claim 1, further comprising:

a one-way clutch provided axially away from the pinion gear to control transmission of rotations between the pinion gear and the starter motor; and the annular arm body is engaged with the pinion transmittal member between the pinion gear and the one-way clutch.

5. The starter according to claim 1, wherein:

the pinion transmittal member includes a plate mounted on the pinion gear and engageable with the annular arm body of the shift lever, and a bearing disposed between the pinion gear and the plate to allow relative rotation between the pinion gear and the plate.

* * * * *